US011224099B2

(12) United States Patent
Becker et al.

(10) Patent No.: US 11,224,099 B2
(45) Date of Patent: Jan. 11, 2022

(54) MINERAL INSULATED CABLE HAVING REDUCED SHEATH TEMPERATURE

(71) Applicant: nVent Services GmbH, Schaffhausen (CH)

(72) Inventors: Paul Becker, San Carlos, CA (US); Fuhua Ling, Milpitas, CA (US); Ningli Liu, Cupertino, CA (US); Lawrence Joseph White, Newark, CA (US); Louis Peter Martin, II, San Ramon, CA (US); Scott Murray Finlayson, Belleville (CA); James Francis Beres, Incline Village, NV (US); Marcus Kleinehanding, Brussels (BE)

(73) Assignee: nVent Services GmbH, Schaffhausen (CH)

( * ) Notice: Subject to any disclaimer, the term of this patent is extended or adjusted under 35 U.S.C. 154(b) by 637 days.

(21) Appl. No.: 16/128,344

(22) Filed: Sep. 11, 2018

(65) Prior Publication Data

US 2019/0021138 A1 Jan. 17, 2019

Related U.S. Application Data

(63) Continuation of application No. 13/931,863, filed on Jun. 29, 2013, now Pat. No. 10,076,001.

(Continued)

(51) Int. Cl.
*H05B 3/02* (2006.01)
*H05B 3/56* (2006.01)

(Continued)

(52) U.S. Cl.
CPC ..... *H05B 3/02* (2013.01); *H05B 3/08* (2013.01); *H05B 3/50* (2013.01); *H05B 3/56* (2013.01);

(Continued)

(58) Field of Classification Search
CPC ..... H05B 3/50; H05B 3/56; H05B 2203/01; H05B 3/02; H05B 3/08; Y10T 29/49083
See application file for complete search history.

(56) References Cited

U.S. PATENT DOCUMENTS 2,767,288 A 10/1956 Lennox
2,816,200 A 12/1957 Mudge (Continued)

FOREIGN PATENT DOCUMENTS

CN 201550304 U 8/2010
EP 0419351 A1 * 3/1991 ..... H05B 3/48

(Continued)

*Primary Examiner* — Dana Ross
*Assistant Examiner* — Kuangyue Chen
(74) *Attorney, Agent, or Firm* — Quarles & Brady LLP

(57) ABSTRACT

A mineral insulated heating cable for a heat tracing system. The heating cable includes a sheath having at least a first, and optionally a second layer, wherein the thermal conductivity of the second layer is greater than a thermal conductivity of the first layer. In addition, the first and second layers are in intimate thermal contact. The heating cable also includes at least one heating conductor for generating heat and a dielectric layer located within the sheath for electrically insulating the heating conductor, wherein the sheath, heating conductor and dielectric layer form a heating section. In addition, the heating cable includes a conduit for receiving the heating section. Further, the heating cable includes a cold lead section and a hot-cold joint for connecting the heating and cold lead sections. In addition, a high emissivity coating may be formed on the first layer.

8 Claims, 8 Drawing Sheets

Related U.S. Application Data

(60) Provisional application No. 61/668,305, filed on Jul. 5, 2012.

(51) Int. Cl.
*H05B 3/08* (2006.01)
*H05B 3/50* (2006.01)

(52) U.S. Cl.
CPC ... *H05B 2203/011* (2013.01); *Y10T 29/49083* (2015.01)

(56) References Cited

U.S. PATENT DOCUMENTS

| | | | | |
|---|---|---|---|---|
| 3,214,571 | A | 10/1965 | Indoe | |
| 3,248,813 | A | 5/1966 | Quick | |
| 3,369,209 | A | 2/1968 | Edwin et al. | |
| 3,657,513 | A | 4/1972 | Howard | |
| 4,631,392 | A | 12/1986 | O'Brien et al. | |
| 4,704,514 | A | 11/1987 | Van Egmond et al. | |
| 4,705,106 | A | 11/1987 | Hornack et al. | |
| 5,974,343 | A * | 10/1999 | Brevard | A61B 18/18 607/102 |
| 2007/0193747 | A1 | 8/2007 | de St. Remey et al. | |
| 2007/0237497 | A1 | 10/2007 | Lehmann | |
| 2009/0189617 | A1 * | 7/2009 | Burns | E21B 43/24 324/649 |
| 2010/0089584 | A1 * | 4/2010 | Burns | H01C 3/00 166/302 |

FOREIGN PATENT DOCUMENTS

| | | | |
|---|---|---|---|
| EP | 0419351 | A1 | 3/1991 |
| EP | 1918941 | A1 | 5/2008 |
| GB | 2224189 | A | 4/1990 |
| KR | 20090017369 | A | 2/2009 |

* cited by examiner

MINERAL INSULATED CABLE HAVING REDUCED SHEATH TEMPERATURE

RELATED APPLICATIONS

This application is a continuation of U.S. application Ser. No. 13/931,863 filed on Jun. 29, 2013, which claims priority under 35 U.S.C. § 119 to U.S. Provisional Patent Application No. 61/668,305 filed on Jul. 5, 2012, the entire contents of which are incorporated herein by reference.

FIELD OF THE INVENTION

This invention relates to mineral insulated heating cables used, in heat tracing systems, and more particularly, to embodiments for mineral insulated cables that have a reduced sheath temperature.

BACKGROUND

Electrical heat tracing systems frequently utilize mineral insulated (MI) heating cables which function as auxiliary heat sources to compensate for heat losses encountered during normal operation of plants and equipment such as pipes, tanks, foundations, etc. Typical applications for such systems include freeze protection and process temperature maintenance.

MI cables are designed to operate as a series electrical heating circuit. When used in hazardous area locations, i.e. areas defined as potentially explosive by national and international standards such as NFPA 70 (The National Electrical Code), electrical heat tracing systems must comply with an additional operational constraint which requires that the maximum surface or sheath temperature of the heating cable does not exceed a local area auto-ignition temperature (AIT). Maximum sheath temperatures often occur in sections of the heat tracing system where the heating cable becomes spaced apart from the substrate surface (such as a pipe) and is no longer in direct contact with it, i.e. where the cable is no longer effectively heat sunk. Such sections are typically located where heating cables are routed over complex shapes of a heat tracing system. With respect to the heat tracing of pipes, this occurs in areas around flanges, valves and bends, for example, of a piping system.

Frequently, a heat tracing system designer is not able to utilize a single run or pass of cable for a particular installation since the higher wattage typically utilized in single runs may result in a maximum sheath temperature that exceeds the AIT. Instead, the designer will specify several lower-wattage cables operated in parallel so that the heat tracing system will operate at a low enough power density to ensure the cable sheath temperatures stay below the AIT. For example, if a piping system requires 20 watts/foot of heat tracing, the designer may have to specify two passes of 10 watt/foot cable instead of one pass of 20 watt/foot cable to keep the maximum sheath temperature of the heating cables below the AIT. In this example, the two-pass configuration will increase the cost of the installed heat tracing and can also result in configurations that are difficult to install when there is physically not enough room (such as on a small valve or pipe support) to place the multiple passes of heating cable. Thus, it would be desirable to operate a heating cable at increased power densities while reducing both the maximum sheath temperature to below the AIT and the number of passes of cable for a given application.

An approach is to use heat transfer compounds to reduce sheath temperature in electric heating cables. Heat transfer compounds have been used in the steam tracing industry to increase the heat transfer rate from steam tracers to piping. However, such compounds are only allowed in certain lower risk hazardous areas, require additional labor and material costs, and are difficult to install in non-straight sections of heat tracing, for example, around flanges, valves and bends where higher sheath temperatures are often found.

Another approach used for extreme high temperature applications in straight heating rods is to increase the surface emissivity of the heater. This increases the heater's performance by improving the efficiency of radiation heat transfer and allowing the heater to run cooler and last longer. The increase in emissivity occurs when the surface is oxidized. While increasing the emissivity can be used to decrease heating cable sheath temperatures, this approach is limited since it is most effective only at very high temperatures.

A further approach involves increasing the surface area of heating cables to improve radiation and convection heat transfer. Because of its larger surface area, a larger diameter MI cable will have a lower sheath temperature compared with a smaller diameter cable when both are operated at the same heat output (watts/foot). However, this approach increases the material costs and the stiffness of the cable.

Parallel circuit heating cables are desirable for their cut-to-length feature that is useful when installing field-run heat tracing. However, parallel heating cables employ a heating element spaced between two bus conductors and tend to be larger than their series counterparts. There are commercial non-polymeric parallel heating cables that are assembled by positioning a heating element, electrical insulation and bus conductors inside an oval-shaped flexible metal sheath or jacket. The jacket serves to house the heating element, electrical insulation and bus conductors and thus the jacket is part of the heating cable itself. In addition, the jacket protects the heating, insulating and conductor elements from impact and the environment. However, such parallel heating cables tend to be large and thus are rather stiff and their oval shape makes them difficult to bend especially in certain directions. They also have open ends and space within the cable that allows for moisture ingress that can cause electrical failure.

SUMMARY

A mineral insulated heating cable for a heat tracing system is disclosed. The heating cable includes a sheath having at least a first, and optionally a second layer, wherein the thermal conductivity of the second layer is greater than a thermal conductivity of the first layer. In addition, the first and second layers are in intimate thermal contact. The heating cable also includes a least one heating conductor for generating heat and a dielectric layer located within the sheath for electrically insulating the heating conductor, wherein the sheath, heating conductor and dielectric layer form a heating section. In addition, the heating cable includes a conduit for receiving the heating section. Further, the heating cable includes a cold lead section and a hot cold joint for connecting the heating and cold lead sections. In addition, a high emissivity coating may be formed on the first layer. Further, at least one cooling fin may be attached to a heating section to reduce sheath temperature.

DETAILED DESCRIPTION

Figure 1:
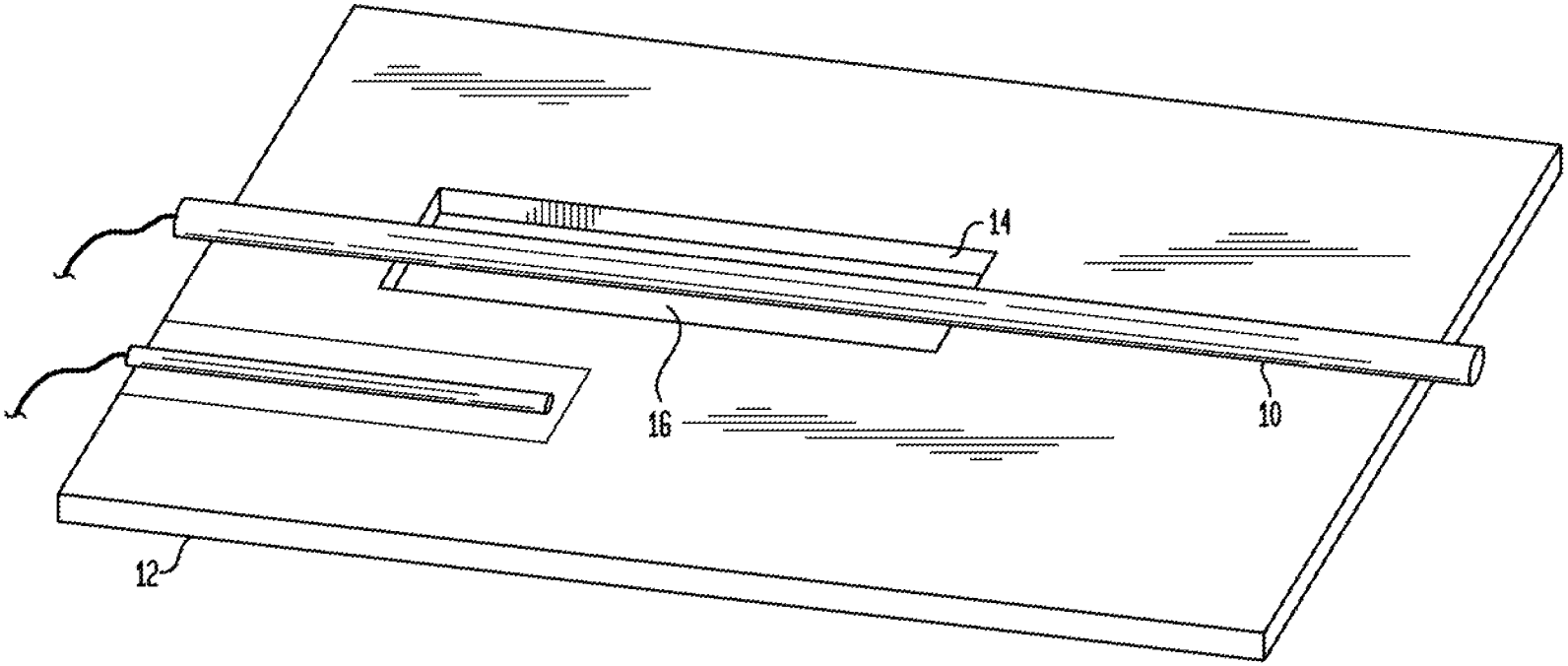
FIG. 1 depicts a test set up for measuring a mineral insulated heating cable sheath temperature.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings. In the description below, like reference numerals and labels are used to describe the same, similar or corresponding parts in the several views of FIGS. 1-9B.

Method for Measuring Maximum Cable Sheath Temperatures

In order to measure maximum sheath temperatures we have used the plate test described in IEEE 515-2011, *Standard for the Testing, Design, Installation, and Maintenance of Electrical Resistance Heat Tracing for Industrial Applications*. As part of a test set up (see FIG. 1), a mineral insulated (MI) heating cable 10 is placed in contact with a metal plate 12 whose temperature is controlled at a fixed value (such as 50° C., 100° C. or 300° C.). The plate 12 functions as a substrate representing a heated pipe surface. The plate 12 includes a cut-out rectangular groove 14 that is approximately 5 mm deep, 300 mm long and 50 mm wide to form a bottom surface 16. A portion of the heating cable 10 extends across the groove 14, resulting in the heating cable 10 being suspended in air approximately 5 mm from the bottom surface 16 of the groove 14. The heating cable 10 will typically develop its maximum sheath temperature at the mid-way point of the suspended section. Small gauge thermocouples are attached to the top of the heating cable 10 in this region to record the maximum sheath temperatures. The entire plate 12 and heating cable 10 are thermally insulated using a combination of mineral wool, such as Rockwool® mineral wool, and calcium silicate insulating materials. With the plate 12 operating at a fixed temperature, the heating cable 10 is electrically powered and allowed to come to thermal equilibrium at which point the current, voltage and sheath temperatures are recorded.

Description of Embodiments

There are three different mechanisms by which heat loss occurs from a heating cable: radiation, conduction and convection. Maximum cable sheath temperatures can be reduced by modifying the heat tracing system to enhance its heat loss via any of these mechanisms used alone or in combination.

Figure 2:
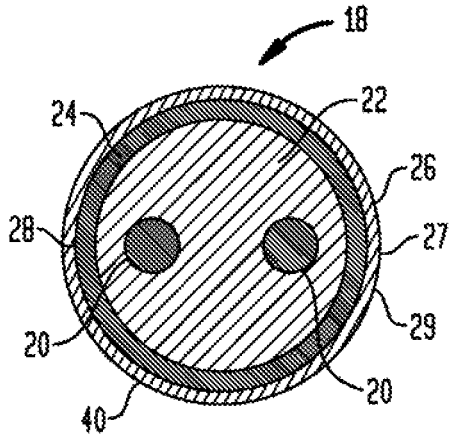
FIG. 2 is a cross sectional end view of a heating section of the heating cable.

Referring to FIG. 2, a cross sectional end view of a heating section 40 (see FIG. 4) of a mineral insulated (MI) heating cable 18 is shown. The heating section 40 includes a pair of heating conductors 20 which generate heat for heating a substrate such as a pipe. Alternatively, one or more than two heating conductors 20 may be used. The heating conductors 20 are embedded in a dielectric layer 22 which may be fabricated from magnesium oxide, doped magnesium oxide or other suitable electrical insulation material. The dielectric layer 22 is surrounded by a single layer sheath 24 which is fabricated from a metal such as Alloy 825, copper, stainless steel or other material suitable for use in a heating cable.

In one aspect of the invention, a maximum temperature for the single layer sheath 24 (for example, occurring at one or more "hot spots") is reduced by increasing the emissivity of the sheath surface to improve radiation heat transfer. A typical single layer cable sheath 24 made of Alloy 825 or stainless steel has an emissivity value from approximately 0.1 to 0.4. The emissivity value may be increased to approximately 0.6 or greater by applying a high emissivity coating 26 to the single layer sheath 24. This approach is most effective for cables that will be operating at high temperatures since radiated heat (loss) is proportional to $T^4$ (K). In one example using a 0.25 in. outer diameter heating section 40, we found that coating a single layer sheath 24 with a high temperature coating such as Hie-Coat™ 840CM high emissivity coating supplied by Aremco Products Inc. decreased the maximum sheath temperature by approximately 29° C. when powered at 10 watts/foot with the temperature of the plate 12 maintained at approximately 150° C. Alternatively, an outer surface 28 of the single layer sheath 24 may be oxidized to form an oxidized layer 27 or the outer surface 28 may be subjected to a black anodizing process to form an anodized layer 29.

Figure 3:
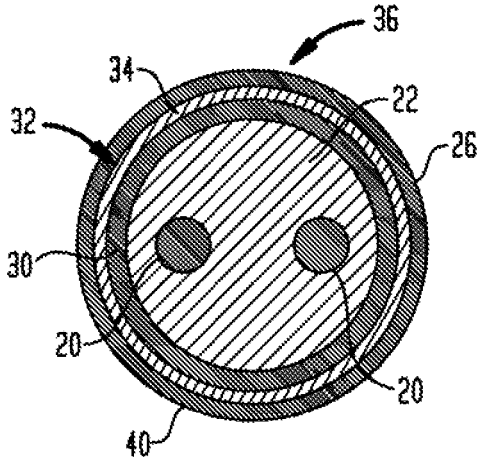
FIG. 3 is a cross sectional end view of an alternate embodiment of the heating section of a heating cable.

Referring to FIG. 3, a cross sectional end view of an alternate embodiment of the heating section 40 (see FIG. 4) of a mineral insulated (MI) heating cable 36 is shown. In another aspect of the invention, the maximum sheath temperature is reduced by increasing the thermal conductivity of the sheath. In accordance with the invention, a multilayer sheath is fabricated by adding to, or substituting all or a portion of a sheath with a material having a higher thermal conductivity. This enables or facilitates the removal of heat from a higher temperature area on the sheath by conducting it to a lower temperature area to thus reduce the maximum sheath temperature. This approach is most effective in configurations where there is a large temperature difference along the length of the heating cable and for larger cables having thicker sheaths, i.e. lower thermal resistance.

The thermal conductivity of a typical sheath made of Alloy 825 is approximately 15 $W \cdot m^{-1} \cdot K^{-1}$. In the alternate embodiment, a portion of the sheath is fabricated from a material having a thermal conductivity greater than 20 $W \cdot m^{-1} \cdot K^{-1}$ to form an effective thermal conductivity of greater than 20 $W \cdot m^{-1} \cdot K^{-1}$ for the sheath. By way of example, a material such as copper (having a thermal conductivity of approximately 400 $W \cdot m^{-1} \cdot K^{-1}$) may be utilized in the sheath in addition to Alloy 825. Referring to FIG. 3, a bilayer sheath 32 is shown having an inner layer 30 that is fabricated from a material having a high thermal conductivity such as copper or other suitable material. The inner layer 30 is located within an outer layer 34 that is fabricated from a material that provides high corrosion resistance, such as Alloy 825, or other suitable material, to form a bilayer configuration. The inner layer 30 is in intimate thermal contact with the outer layer 34 thus providing a conductive path for heat generated by the heating conductors 20. The heating section 40 also includes the heating conductors 20 embedded in a dielectric layer 22 which may be fabricated from magnesium oxide, doped magnesium oxide or other suitable insulation material as previously described. In one example using a 0.25 in. outer diameter heating section 40, we found that the bilayer configuration decreased the maximum sheath temperature by approximately 28° C. when powered at 10 watts/foot with the temperature of the metal plate 12 maintained at approximately 150° C. In accordance with the invention, a thickness of the inner layer 30 is greater than approximately 10% of a thickness of the bilayer sheath 32. For suitable corrosion resistance, the outer layer 34, when fabricated from Alloy 825, is preferably approximately at least 0.002 in. thick. Alternatively, the outer layer 34 is fabricated from stainless steel. Further, the bilayer sheath 32 may include more than one inner layer 30 or more than one outer layer 34 in order to provide suitable thermal conductivity and corrosion resistance for the heating section 40.

The maximum cable sheath temperature may be further reduced by combining the approaches described herein. An approach is to apply the high emissivity coating 26 to the outer layer 34 of the bilayer sheath 32 to increase the emissivity value to approximately 0.6 or greater. In one example using a 0.25 in. outer diameter heating section 40, we found that this combined approach decreased the maximum sheath temperature by approximately 45° C. when powered at 10 watts/foot with the temperature of the plate 12 set at approximately 150° C.

The bilayer sheath 32 may be formed by placing a copper inner tube inside an alloy 825 outer tube. A cold drawing and annealing process is then applied to both tubes simultaneously to produce a bilayer in intimate thermal contact. The sheath may then be coated with an adherent high emissivity material and/or oxidized.

Figure 4:
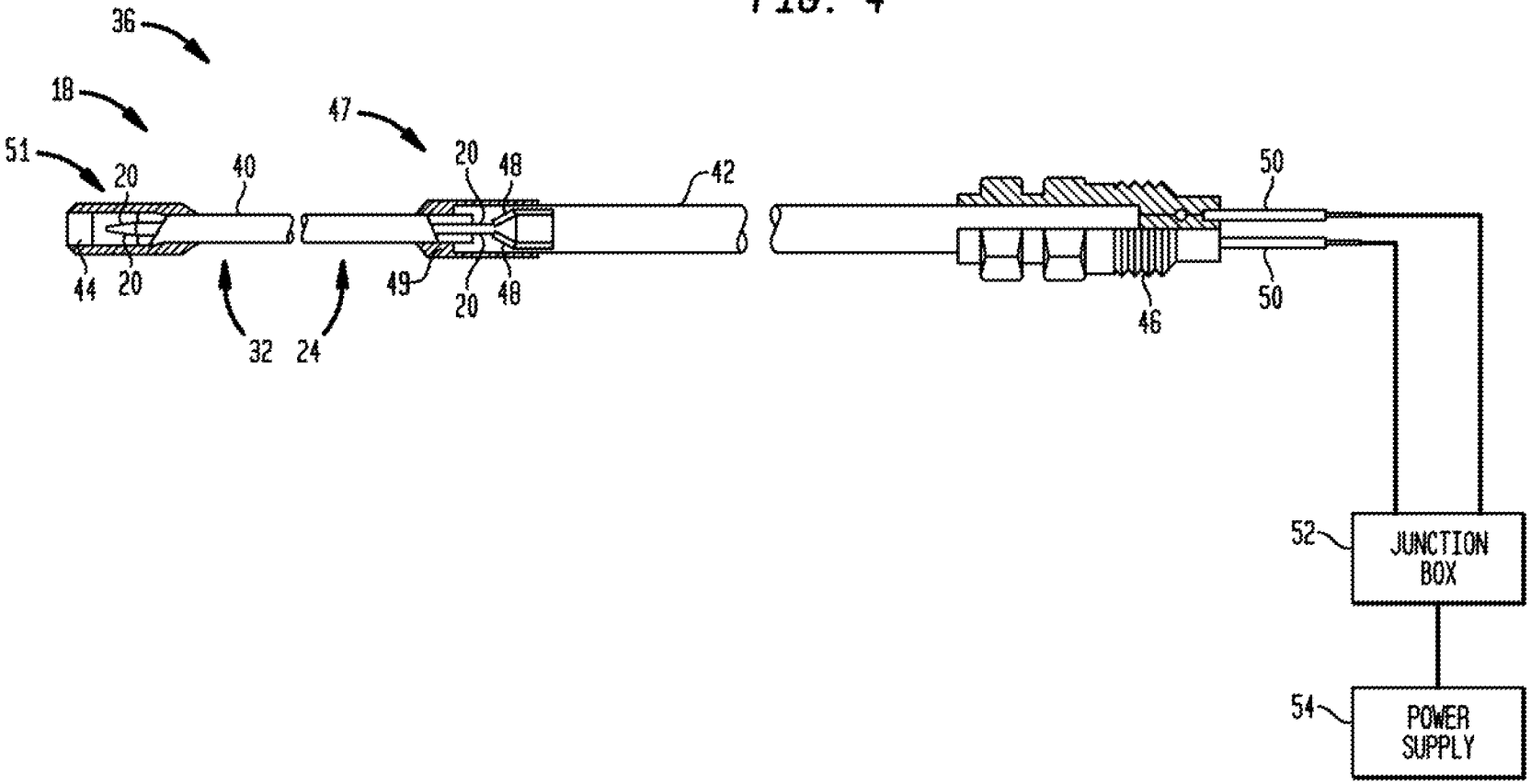
FIG. 4 is a side view of an embodiment of a heating cable.

Referring to FIG. 4, a side view of an embodiment of a heating cable, such as heating cable 36 having heating section 40 that includes bilayer sheath 32 is shown. It is noted that the following description is also applicable to heating cable 18 having heating section 40 that includes single layer sheath 24. The heating section 40 and a non-heating cold lead section 42 are located between an end cap 44 and a connector 46. The heating section 40 includes the heating conductors 20 as previously described or other heating elements for heating a substrate. First ends 47 of the heating conductors 20 are connected to respective bus wires 48 at a hot-cold joint 49. The bus wires 48 extend through the cold lead section 42 and are connected via connector 46 to respective tail leads 50 which extend from the connector 46. The tail leads 50 are connected at an electrical junction box 52 to a power source or circuit for powering the heating cable 36. Second ends 51 of the heating conductors 20 are joined and sealed within the end cap 44 to provide isolation from environmental conditions.

Figure 5:
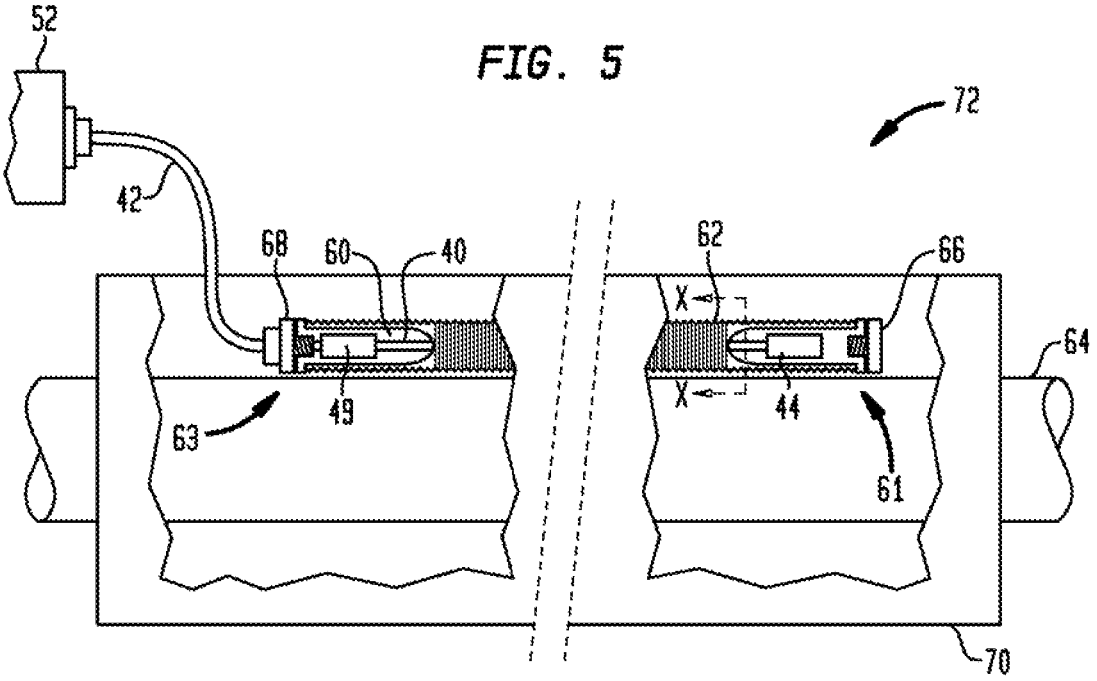
FIG. 5 depicts a heating section of a heating cable located within an internal cavity of a conduit.

The maximum cable sheath temperature can also be reduced by increasing the cable surface area. This approach improves both radiative and convective heat losses. Referring to FIG. 5, a heating section 40 of a heating cable, such as heating cable 36 which includes bilayer sheath 32, is located within an internal cavity 60 of a conduit 62. Alternatively, heating section 40 of heating cable 18, which includes single layer sheath 24, may be used. In one embodiment, the conduit 62 is corrugated and fabricated from stainless steel. Alternatively, the conduit 62 may be fabricated from a nickel based alloy or other corrosion resistant alloy. The conduit 62 is positioned on, and in thermal contact with, a substrate 64, such as a portion of a pipe, which is to be heated. Thermal insulation 70 is positioned around the conduit 62 and pipe 64. A first end 61 of the conduit 62 adjacent the end cap 44 is closed with a first compression fitting 66. A second end 63 of the conduit 62 adjacent the hot-cold joint 49 is closed by a second compression fitting 68. The cold lead section 42 extends through the second compression fitting 68. The first 66 and second 68 fittings may be brazed, welded or compression fit into the conduit 62 to form an integrated heating section and conduit unit 72 which is sealed from environmental conditions.

Figure 5A:
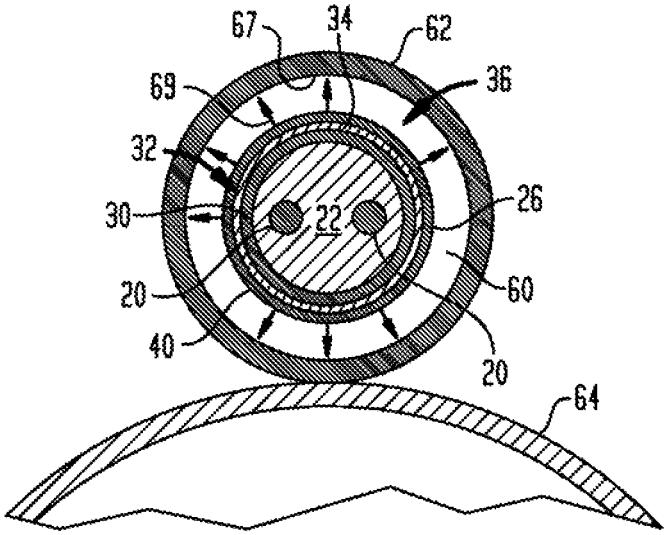
FIG. 5A is a cross sectional view along view line X-X of FIG. 5 depicting a bilayer sheath within the conduit.
Figure 5B:
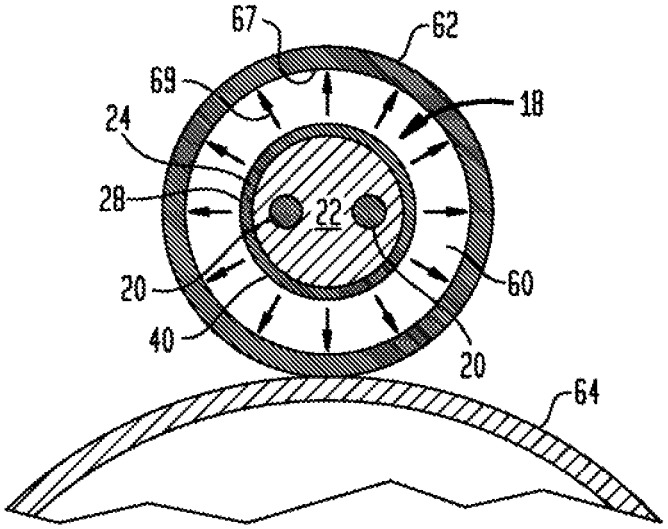
FIG. 5B is a cross sectional view along view line X-X of FIG. 5 depicting a single layer sheath within the conduit.

Referring to FIG. 5A, a cross sectional view along line X-X of FIG. 5 is shown. FIG. 5A depicts bilayer sheath 32 within the internal cavity 60 of conduit 62. Heat generated by heating conductors 20 is conducted by the bilayer sheath 32. The heat is then radiated (see arrows 69) to an interior wall 67 of the conduit 62. FIG. 5B depicts an alternate embodiment wherein only single layer sheath 24, without high emissivity coating 26, is located within the internal cavity 60 of conduit 62. The heat is then transferred (see arrows 69) to an interior wall 67 of the conduit 62 in a similar manner to that described in relation to FIG. 5A. To be effective, the surface area of the conduit 62 must be at least approximately 2.5 times greater than the area of the outer surface of the heating section 40. In one example we found that a 3.2 mm heating section placed in a 8.3 mm inner diameter/12 mm outer diameter stainless corrugated conduit (such as type RSM 331S00 DN8 sold by WITZENMANN, for example, having an outer surface area that is approximately 7 times greater than that of the heating section) decreased the maximum sheath temperature (as measured on the surface of the conduit) by approximately 75° C. when powered at 10 watts/foot with the temperature of the plate 12 set at approximately 150° C. In one embodiment, the size of the conduit 62 may vary in accordance with the size of portions of the heating cable 36. For example, the conduit 62 may have a first size which corresponds to a size of a first portion of a heating cable 36. The size of the conduit 62 is then locally increased to correspond to a size of a second portion of the heating cable 36 so that the conduit 62 fits over any splices in the heating cable 36, for example.

Figure 6:
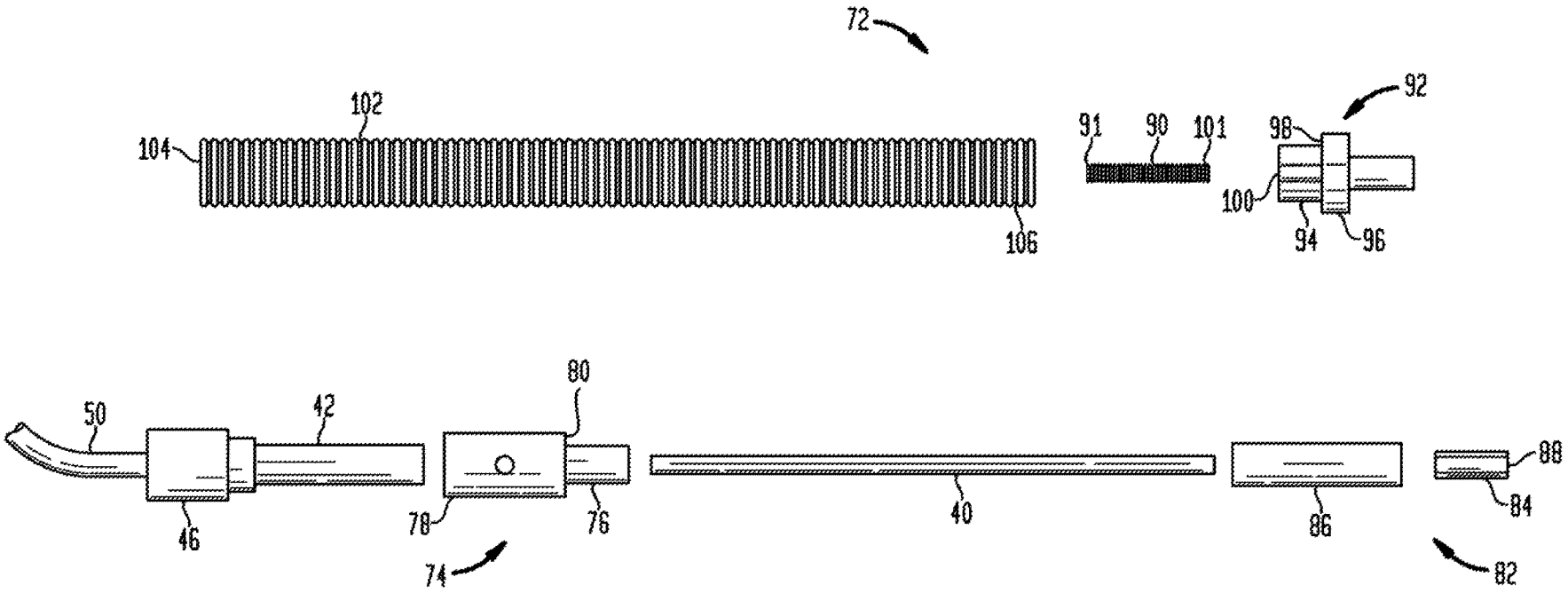
FIG. 6 is an exploded view of an alternate embodiment of a heating section and conduit unit.

Referring to FIG. 6, an alternate embodiment of the heating section and conduit unit 72 is shown as an exploded view. The unit 72 includes a hot-cold joint 74 having a first joint section 76 that is smaller in size than a second joint section 78 to form a stepped joint configuration having a first shoulder 80. In addition, the unit 72 includes an end cap 82 having an end cap plug 84 which is adapted to be affixed to an end cap section 86 to close the end cap section 86. The end cap plug 84 includes a blind threaded hole 88 for receiving a first end 91 of a threaded stud 90. The unit 72 also includes a conduit plug 92 having a first conduit plug section 94 that is smaller in size than a second conduit plug section 96 to form a stepped plug configuration having a second shoulder 98. The first conduit plug section 94 includes a threaded hole 100 for receiving a second end 101 of the stud 90. The first joint section 76, end cap plug 84, end cap section 86 and first conduit plug section 94 are each sized to fit within a conduit 102. As previously described in relation to FIG. 4, heating section 40, which includes either heating section 40 of heating cable 36 having bilayer sheath 32 or heating section 40 of heating cable 18 having single layer sheath 24, includes heating conductors or other heating elements for heating a substrate. In addition, first ends of the heating conductors are connected to respective bus wires at the hot-cold joint 74. The bus wires extend through the cold lead section 42 and are connected to respective tail leads 50 which extend from the connector 46. Further, second ends of the heating conductors 20 are joined and sealed within the end cap 82 to provide isolation front environmental conditions.

Figure 7:
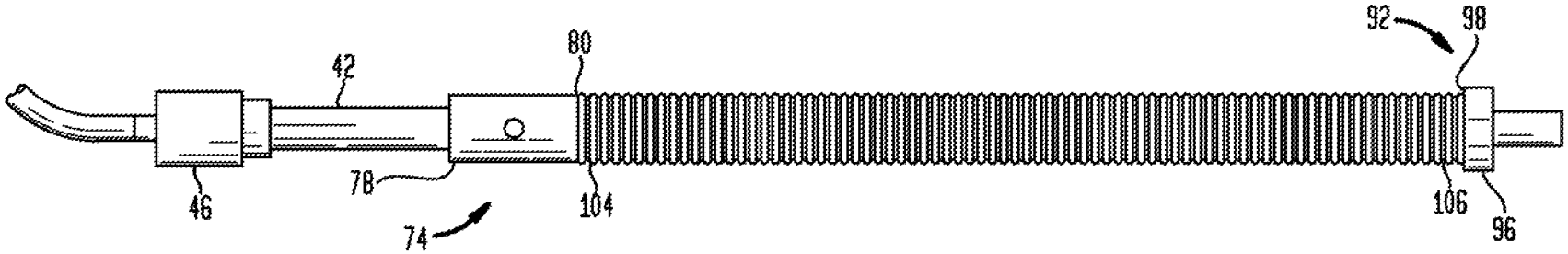
FIG. 7 depicts an assembled view of the heating section and conduit unit shown in FIG. 6.

In order to assemble the unit 72, the conduit 102 is slid over the end cap plug 84, end cap section 86, heating section 40 and the first joint section 76 until first conduit end 104 abuts against the first shoulder 80. In addition, the second end 101 of stud 90 is threadably engaged within hole 100 of the first conduit plug section 94. The first end 91 of stud 90 is then threaded within hole 88 of end cap plug 84 until a second conduit end 106 abuts against second shoulder 98 to form an integrated heating section and conduit unit which is sealed from environmental conditions. FIG. 7 depicts an assembled view of the unit 72 shown in FIG. 6.

Figure 8A:
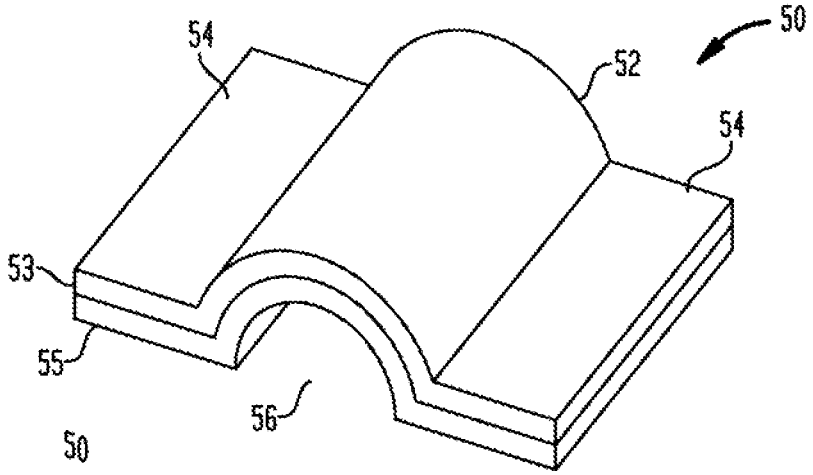
FIGS. 8A and 8B depict alternate embodiments of a fin used in conjunction with a heating cable.
Figure 8B:
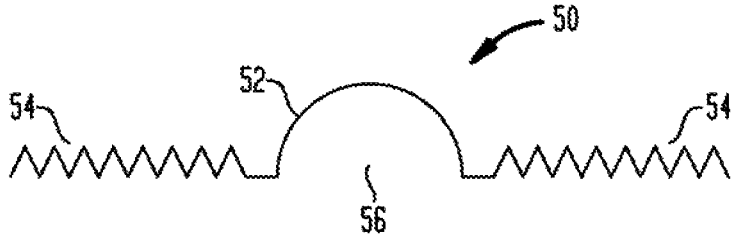
Figure 9A:
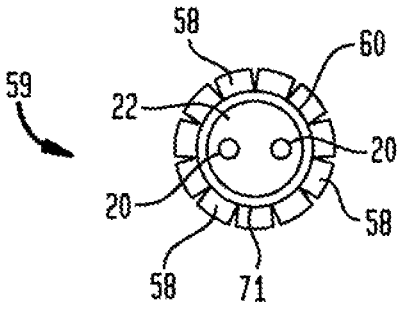
FIGS. 9A and 9B depict cross sectional and side views, respectively, of all alternate fin arrangement.
Figure 9B:
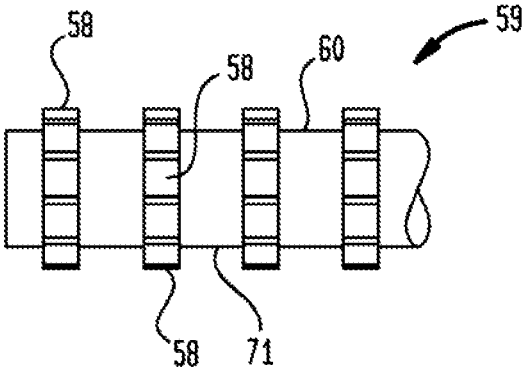

Furthermore, cooling fins may also be used to reduce sheath temperature. For example, fins may be used in areas where a portion of a heating section 40 lifts off a pipe. Referring to FIG. 8A, a fin 50 includes a center portion 52 located between wing portions 54. The center portion 52 includes a curved portion to form a cavity or groove 56 for receiving a portion of a heating section 40 which is spaced apart from a pipe. Alternatively, the groove 56 may be configured to enable a snap on connection onto the heating section 40. Referring to FIG. 8B, the wings 54 may also be pleated to increase surface area to provide further dissipation of heat. The fin 50 is fabricated from a first fin layer 53 of material having a high thermal conductivity such as aluminum or copper and may be coated to increase emissivity. In addition, the fin 50 may be formed in a bilayer configuration having the first layer 53 and a second fin layer 55 having a thermal conductivity of greater than approximately 20 $W \cdot m^{-1} \cdot K^{-1}$ wherein the first and second layers are fabricated from steel and aluminum or steel and copper, respectively. The bilayer configuration may also be coated to increase emissivity. The fin 50 may also be fabricated from stainless steel only and may include a coating for increasing emissivity. Alternatively, the fin 50 may be fabricated from aluminum tape. In this configuration, the wing portions 54 may then be affixed to the pipe or other surface to position the heating section 40 against the pipe to provide a conductive path. The fin 50 is configured to have an effective thermal conductivity greater than approximately 20 $W \cdot m^{-1} \cdot K^{-1}$. Referring to FIGS. 9A and 9B, cross sectional and side views, respectively, are shown of an alternate fin arrangement 59. Fin arrangement 59 includes a plurality of fin members 58 arranged circumferentially around an outer surface 60 a heating section 71 of a heating cable. Each fin member 58 extends outwardly from the outer surface 60 and is approximately 5 mm in size. The fin members 58 may be arranged in rows or in a staggered arrangement on the outer surface 60. Alternatively, the fin members 58 may be arranged on a substrate such as center portion 52 (see FIG. 8A), which is then snapped on to the heating section 71. The fin members 58 may be fabricated from a material having a high thermal conductivity such as aluminum or copper and may be coated to increase emissivity. In accordance with the invention, more than one fin 50 or fin arrangement 59, and combinations thereof, may be used on a heating section 40.

While the invention has been described in conjunction with specific embodiments, it is evident that many alternatives, modifications, permutations and variations will become apparent to those skilled in the art in light of the foregoing description. Accordingly, it is intended that the present invention embrace all such alternatives, modifications and variations.

The invention claimed is:

1. A mineral insulated heating cable for a heat tracing system, comprising:

a sheath;

at least one heating conductor located within the sheath;

a dielectric layer located within the sheath for electrically insulating the heating conductor, wherein the sheath, heating conductor and dielectric layer form a heating section; and a conduit, wherein a full length of the heating section is located within the conduit, the conduit defining an internal cavity sized to create a gap separating the heating section from an interior surface of the conduit along the full length of the heating section so that heat generated by the heating section is transferred to the conduit by radiation.

2. The mineral insulated heating cable of claim 1, wherein the conduit is corrugated.

3. The mineral insulated heating cable of claim 1, wherein a surface area of the interior surface of the conduit is at least approximately 2.5 times greater than an outer surface area of the heating section.

4. The mineral insulated heating cable of claim 1, wherein the heating section is sealed within the conduit via fittings coupled to respective ends of the conduit to provide isolation from environmental conditions.

5. The mineral insulated heating cable of claim 1 and further comprising a cold lead section and a hot-cold joint configured to connect the heating and cold lead sections.

6. The mineral insulated heating cable of claim 5, wherein the hot-cold joint is located at least partially within the conduit and the cold lead section extends out of the conduit.

7. The mineral insulated heating cable of claim 1 and further comprising a high emissivity coating applied to the sheath, the coating having an emissivity value of at least 0.6.

8. The mineral insulated heating cable of claim 1, wherein the sheath includes an outer surface that is one of oxidized to form an oxidized layer or subjected to a black anodizing process to form an anodized layer.

* * * * *